US012759034B2

(12) United States Patent
Xu et al.

(10) Patent No.: US 12,759,034 B2
(45) Date of Patent: Oct. 13, 2026

(54) HEAVY-LOAD AND HIGH-PRECISION TRANSMISSION MECHANISM APPLICABLE TO METAL SHEET BENDING EQUIPMENT

(71) Applicant: Nanjing University Of Posts And Telecommunications, Jiangsu (CN)

(72) Inventors: Fengyu Xu, Jiangsu (CN); Baojie Fan, Jiangsu (CN); Yushi Yang, Jiangsu (CN); Jiandong Tian, Jiangsu (CN); Kaiwei Ma, Jiangsu (CN); Guoping Jiang, Jiangsu (CN)

(73) Assignee: Nanjing University Of Posts And Telecommunications, Jiangsu (CN)

( * ) Notice: Subject to any disclaimer, the term of this patent is extended or adjusted under 35 U.S.C. 154(b) by 802 days.

(21) Appl. No.: 18/035,527

(22) PCT Filed: Sep. 14, 2022

(86) PCT No.: PCT/CN2022/118610
§ 371 (c)(1),
(2) Date: May 5, 2023

(87) PCT Pub. No.: WO2023/040866
PCT Pub. Date: Mar. 23, 2023

(65) Prior Publication Data

US 2023/0330734 A1 Oct. 19, 2023

(30) Foreign Application Priority Data

Sep. 18, 2021 (CN) ..... 202111104793.8

(51) Int. Cl.
*B21D 5/16* (2006.01)

(52) U.S. Cl.
CPC ..... *B21D 5/16* (2013.01)

(58) Field of Classification Search
CPC .. B21D 5/16; B21D 5/02; B21D 5/004; B30B 1/24; B30B 1/06; B30B 15/00
(Continued)

(56) References Cited

U.S. PATENT DOCUMENTS 2,890,649 A * 6/1959 Hodges ..... B21D 5/02 100/231

FOREIGN PATENT DOCUMENTS

CN 110280631 9/2019
CN 110370704 10/2019
(Continued)

OTHER PUBLICATIONS

Machine translation of JP-2017164753-A (Year: 2017).*
(Continued)

*Primary Examiner* — Christopher L Templeton
*Assistant Examiner* — Teresa A Guthrie
(74) *Attorney, Agent, or Firm* — JCIPRNET

(57) ABSTRACT

A heavy-load and high-precision transmission mechanism applicable to sheet-metal bending equipment, which includes pressing arms, connecting rods, hinged supports, pressing arm lifting assemblies and pressing arm lifting driving assemblies. The pressing arms are symmetrically arranged on a top part of a rack. A front end part of each pressing arm facing an upper cross beam is hinged with the cross beam through the connecting rod. An intermediate part of each pressing arm or a rear end part of each pressing arm away from the cross beam is hinged on the rack through the hinged support. The rear end part or the intermediate part of each pressing arm is provided with a set of pressing arm lifting assemblies. Each set of pressing arm lifting assemblies is connected with a set of pressing arm lifting driving assemblies. Each set of pressing arm lifting driving assembly includes an all-electric servo motor.

2 Claims, 16 Drawing Sheets

(58) Field of Classification Search
USPC ..... 72/450
See application file for complete search history.

(56) References Cited

FOREIGN PATENT DOCUMENTS

| | | |
|---|---|---|
| CN | 113828659 | 12/2021 |
| CN | 113976679 | 1/2022 |
| CN | 216175509 | 4/2022 |
| JP | 2014200844 | 10/2014 |
| JP | 2017164753 | 9/2017 |

OTHER PUBLICATIONS

"International Search Report (Form PCT/ISA/210) of PCT/CN2022/118610", mailed on Dec. 8, 2022, with English translation thereof, pp. 1-5.
"Written Opinion of the International Searching Authourity (Form PCT/ISA/237) of PCT/CN2022/118610", mailed on Dec. 8, 2022, pp. 1-5.

* cited by examiner

HEAVY-LOAD AND HIGH-PRECISION TRANSMISSION MECHANISM APPLICABLE TO METAL SHEET BENDING EQUIPMENT

CROSS-REFERENCE TO RELATED APPLICATION

This application is a 371 of international application of PCT application serial no. PCT/CN2022/118610, filed on Sep. 14, 2022, which claims the priority benefit of China application no. 202111104793.8, filed on Sep. 18, 2021. The entirety of each of the above mentioned patent applications is hereby incorporated by reference herein and made a part of this specification.

TECHNICAL FIELD

The present disclosure belongs to the field of numerical control bending, and in particular to a heavy-load and high-precision transmission mechanism applicable to metal sheet bending equipment.

BACKGROUND

The metal sheet processing industry (metal sheet bending processing) is a branch of the metal shaping processing industry (metal sheet bending+punching+forging, and the like), which has developed rapidly in the past 20 to 25 years. In recent years, there is still a superior market growth space for the metal sheet processing, with a growing basically at a rate of 5 to 10% per year. Taking the products of numerical control bending equipment therein as an example, the total annual market sales is approximate 10,000-12,000 units. Based on a selling price of approximate 200,000 per unit, the gross sales of the market should be approximate 2.0 to 2.5 billion.

At present, the numerical control metal sheet bending equipment is mainly divided into two types of numerical control bending machine and numerical control bending center according to the process characteristics, application scope and degree of automation. Both the numerical control bending machine and the numerical control bending center include an upper cross beam, an upper cross beam lifting driving device and an upper die arranged on the bottom part of the upper cross beam.

At present, with reference to the upper cross beam lifting driving device of numerical control bending equipment over 80 tons, the hydraulic driving is mainly adopted in the domestic and foreign markets. The mechanical all-electric servo is still blank at present limited by the influences of the factors such as manufacturing costs, transmission technology, numerical control system and entire machine structure. The advantages of the above-mentioned hydraulic driving are that the driving can be applied to a large tonnage of more than 80 tons, and can implement the bending process of the large-format and thick plates easily. However, the hydraulic driving also has the following deficiencies: 1. the hydraulic driving has a large noise, a high energy consumption, a leakage of hydraulic oil and an environmental pollution.

2. The costs of the hydraulic driving is relatively high, because the costs of high-precision components such as hydraulic cylinders, valve groups, and hydraulic pumps are relatively high, the mid-high-end market of valve groups and hydraulic pump components is almost completely dependent on imports, and the costs is high.

3. The precision of the hydraulic driving is not high, the control for the position precision of the hydraulic system has inherent disadvantages, and the position controllability is poor.
4. The low service life of the hydraulic driving, the wear and tear of components, and the pollution of the hydraulic oil circuit are all likely to have adverse effects on the stability of the hydraulic system.
5. The slider action has a large impact and is not smooth.
6. The hydraulic driving is greatly affected by the environmental factors such as temperature, humidity and dust.
7. The control for the movement is complex.
8. The control system depends on imports.
9. The processing efficiency is low.

In order to solve the above-mentioned deficiencies of the hydraulic driving mode, the technology developed in recent years is mainly in small tonnage bending machines (mainstream 30 to 40 tons), generally no more than 50 tons, and the small tonnage bending machines are widely used and more mature in electronic and communication industries especially in Shenzhen, Guangdong and other areas. At present, most of the small tonnage mechanical all-electric servo bending machines adopt the driving mode of heavy-load ball screw (direct driving, without connecting rod mechanism). The advantages of this driving mode are: simple structure, high mechanical transmission efficiency, fast velocity, high precision, and perfect elimination of many problems of hydraulic transmission. However, this driving mode also has the following deficiencies.

1. The machining and manufacturing precision for the machine tool is high.
2. Since there is no linkage mechanism to increase the force, it is only suitable for small tonnage bending machines under 50 tons.
3. The power utilization rate is low, and the required driving motor power is large, which also increases the cost.
4. Since the screw rod, the upper cross beam and the rack are rigidly connected, the drives on both sides cannot be adjusted synchronously. Therefore, the adjustment of the parallelism on both sides of the screw rod is not synchronized, which causes the screw rod to bend and damages the screw rod.
5. The noisy is high.

However, currently, the market share of the bending machines of 80 tons and above has reached over 80%. But, due to the following reasons, the mechanical all-electric servo has become a bottleneck in replacing the traditional hydraulic transmission.

1. The entire machine belongs to the frame structure of sheet material welding, and structural components such as rack are almost used reaching the strength limit of the material due to the heavy load, and therefore, a reasonable mechanical all-electric servo has a decisive influence on the rigidity and reliability of the entire machine. The transmission mechanism is different, and the corresponding rack structure is also different. The design of the transmission mechanism needs to comprehensively consider various factors such as mechanical performance of the rack of the entire machine, inverse kinematics solution of the mechanism, movement trajectory planning, transmission characteristics of the mechanism, manufacturing costs, difficulty of manufacturing, spatial layout, accumulation of transmission errors, elastic deformation of the transmission mechanism, influence of thermal deformation of the structure, and the adjustment of the left and right parallelism. Due to the characteristics of the structure, transmission mechanisms in other fields and the prior art in this field are generally not suitable for the numerical control bending equipment.

2. The kinematic and mechanical characteristics of the mechanism itself. The bending machine belongs to a typical nonlinear operating condition. Taking the conventional model as an example, the total stroke of the upper die is generally 200 mm (the velocity is required to be 150 to 200 mm/s), but only 20 mm of the working feed stroke (considering the operation safety, the velocity is 20 mm/s) has a load output, and the remaining 180 mm strokes are all empty strokes without any load output. Hence, the mechanical all-electric servo mechanism is required to have nonlinear characteristics, that is, a rapid and low-load movement during the idle stroke, and a slow and large-load output during the feeding stroke. For the above-mentioned small-tonnage ball screw direct-driving as a transmission mode, the velocity and the output force are all fixed values, and the power of the drive motor is not fully utilized, therefore, the large-tonnage bending is not implemented.
3. The kinematic inverse solution of the mechanical all-electric servo, that is, the rotational angle of the drive motor is derived by an analytical method according to the position required by the upper cross beam, which is the premise of realizing high dynamic characteristics and high precision control. However, due to the own characteristics of the mechanical all-electric servo mechanism in prior art, the analytical solution of the inverse kinematics solution cannot be derived, and it can only be derived by the numerical iteration. The calculation of the control system is huge, which affects the velocity. Therefore, the high dynamic characteristics and high precision control is not realized.

Therefore, how to replace the traditional hydraulic transmission with mechanical all-electric servo and implement the transmission mechanism of energy conservation, environmental protection, heavy load and high precision has become a new direction for the development of the metal sheet processing industry. The heavy load refers to 80 tons and above, the high precision refers to the the shaping angle accuracy of metal sheet bending, the accuracy is within 0.5 degrees and the corresponding upper die positioning accuracy reaches 0.025 mm (for example, the angle error of metal sheet bending is 0.5 degrees, the corresponding upper die, that is, the positioning accuracy of the upper cross beam is 0.025 mm).

SUMMARY

The technical problems to be solved by the present disclosure are to provide a heavy-load and high-precision transmission mechanism applicable to metal sheet bending equipment in view of the above-mentioned deficiencies in prior art. The heavy-load and high-precision transmission mechanism applicable to the metal sheet bending equipment can implement the ascending or descending driving for the upper cross beam with the heavy load of 80 tons and above, with a high driving accuracy, an energy conservation and environmental protection, and a simple inverse kinematic solution.

In order to solve the above-mentioned technical problems, the technical solutions adopted in the present disclosure are as follows.

Provided is a heavy-load and high-precision transmission mechanism applicable to metal sheet bending equipment. The mechanism comprises pressing arms, connecting rods, hinged supports, pressing arm lifting assemblies and pressing arm lifting driving assemblies.

The metal sheet bending equipment includes a rack and an upper cross beam. The rack includes two side plates symmetrically arranged on both sides of the rack.

The pressing arms has two, the two pressing arms are symmetrically arranged on upper parts of both sides of the rack.

A front end part of each pressing arm facing the upper cross beam is hinged at a top end of the connecting rod, and a bottom end of the connecting rod is hinged with the upper cross beam.

An intermediate part of each pressing arm or a rear end part of each pressing arm away from the upper cross beam is hinged on the hinged support, and the hinged support is fixedly installed or integrally arranged on the rack.

The rear end part or the intermediate part of each pressing arm is provided with a set of pressing arm lifting assemblies. Each set of pressing arm lifting assemblies is connected with at least one set of pressing arm lifting driving assemblies, and each set of pressing lifting driving assemblies includes an all-electric servo motor.

The pressing arm lifting assemblies are rotatable or slidable driven by the corresponding pressing arm lifting driving assembly, thereby driving the pressing arm to swing up and down around the hinged support and driving the upper cross beam to ascend and descend in height.

Each set of pressing arm lifting assemblies includes a pressing rod capable of swinging, and a top end of the pressing rod is hinged with the rear end part or the intermediate part of the pressing arm.

Each set of pressing arm lifting driving assemblies further includes a crankshaft and a crankshaft rotating driving device configured to drive the crankshaft to rotate. A bottom end of the pressing arm is directly or indirectly hinged with the crankshaft.

The crankshaft rotating driving device includes the all-electric servo motor and a pinion. The all-electric servo motor is configured to drive the pinion to rotate, and the crankshaft has external teeth in engagement with the pinion.

Each set of pressing arm lifting assemblies further includes a pushing rod and a supporting rod. A top end of the pushing rod is hinged at a bottom end of the pressing rod, a bottom end of the pushing rod is hinged with the crankshaft. The supporting rod is hinged at a hinging point between the pushing rod and the pressing rod, and another end of the supporting rod is hinged on the rack correspondingly.

Each set of pressing arm lifting assemblies further includes a connecting block and a supporting rod. A bottom end of the pressing rod and a top end of the supporting rod are all hinged with the connecting block, and a bottom end of the supporting rod is hinged on the rack.

The pressing arm lifting driving assembly further includes a screw rod and a bearing seat. The bearing seat is hinged on the rack, the all-electric servo motor is installed in the bearing seat, the all-electric servo motor is configured to drive the screw rod to rotate, and the connecting block is threadedly sleeved on the screw rod.

The intermediate part of each pressing arm is hinged on the rack through the hinged support correspondingly, and the top end of the pressing rod is hinged with the rear end part of the pressing arm. Each set of pressing arm lifting driving assemblies includes the all-electric servo motor, the screw rod and a sliding block. The all-electric servo motor is configured to drive the screw rod to rotate, and the sliding block is threadedly sleeved on the screw rod, and the sliding block is hinged at the bottom end of the pressing rod.

A top part of the rack away from the upper cross beam is provided with a sliding track. The sliding block is slidably installed on the sliding track. A sliding pair is formed between the sliding block and the sliding track, and a direction of the screw rod is in consistent with that of the sliding track.

The intermediate part of each pressing arm is hinged on the rack through the hinged support, and each set of the pressing arm lifting assemblies includes a connecting block hinged at the rear end of the corresponding pressing arm.

Each set of the pressing arm lifting driving assemblies further includes the bearing seat and the screw rod. The bearing seat is hinged on the rack. The all-electric servo motor is installed in the bearing seat. The all-electric servo motor is configured to drive the screw rod to rotate, and the connecting block is threadedly sleeved on the screw rod.

The length of each connecting rod is adjustable.

When the metal sheet bending equipment is a bending center, the rack includes at least one reinforcing plate and an upper vertical plate, an intermediate part of the reinforcing plate is provided with an avoidance hole, the upper vertical plate is vertically and fixedly installed at a front end of the reinforcing plate, and the upper cross beam is capable of ascending or descending vertically along the upper vertical plate.

The present disclosure has the following beneficial effects.

1. The all-electric servo motor replaces the traditional hydraulic, which has an energy conservation and environmental protection.
2. Due to the nonlinear motion characteristics of the mechanism, the transmission mechanism is suitable for large tonnage.
3. Since the force-bearing point of the rack is more reasonable, in the present disclosure, the force-bearing point of the rack is transferred to a position approximate to the middle position of the body through the pressing arm, and no additional bending moment exists, therefore, the force-bearing of the structure is reasonable, no stress concentration point exists, and the rigidity is reliable.
4. The inverse kinematics solution is simpler and easier to be controlled.
5. The noise is low, and no noise pollution exists.
6. The appearance is compact and more beautiful.

Figure 2:
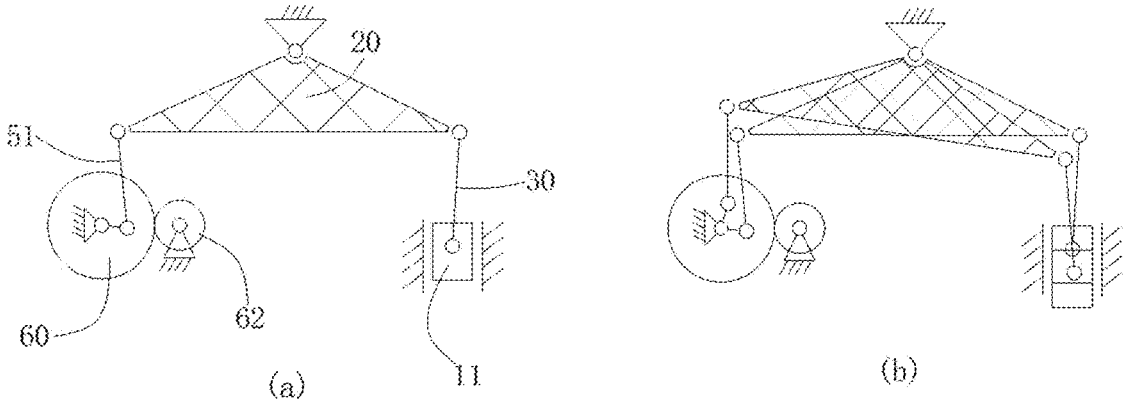

Parts (a) and (b) of FIG. 2 illustrates a schematic diagram of Embodiment 1 in the present disclosure.

Figure 3:
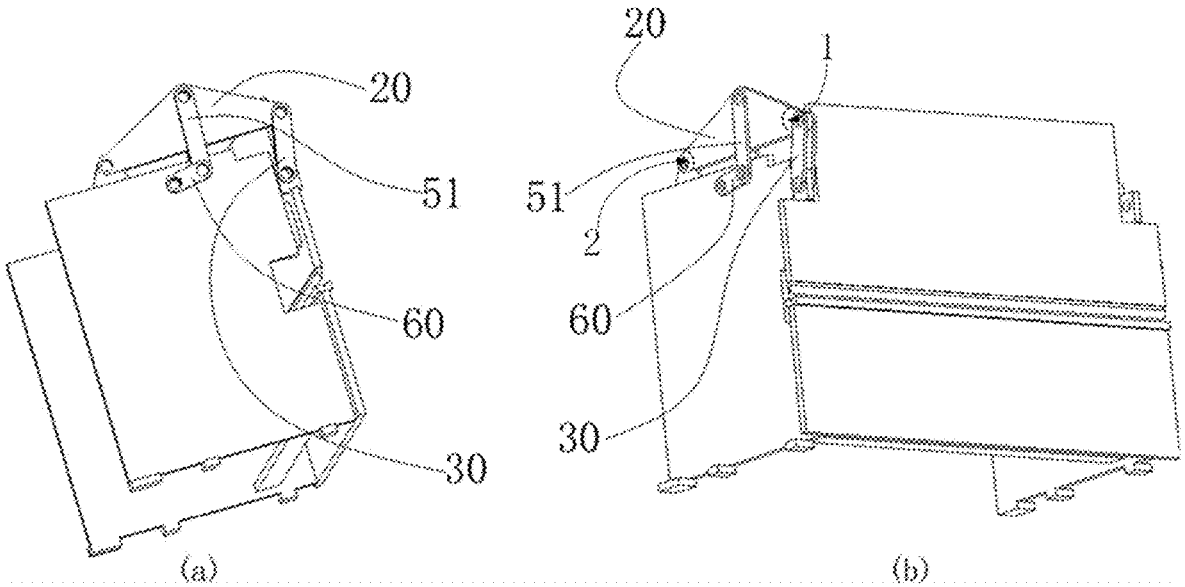

FIG. 3 illustrates a structural stereogram of Embodiment 2 in the present disclosure, (a) of FIG. 3 illustrates a three-dimensional view 1, and (b) of FIG. 3 illustrates a three-dimensional view 2.

Figure 4:
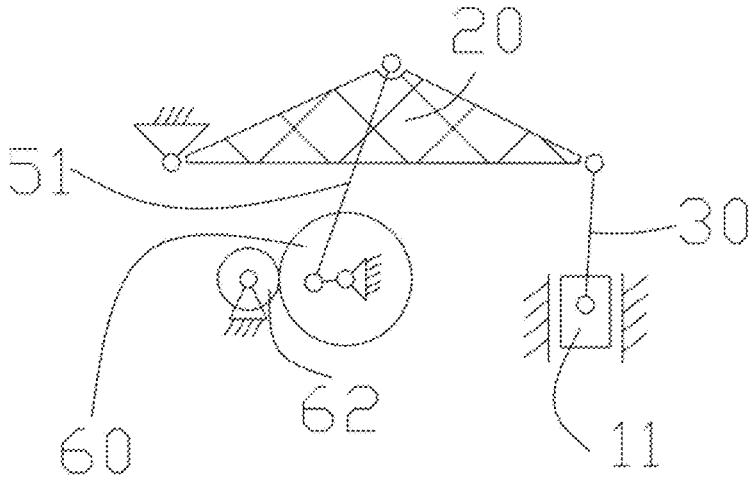

FIG. 4 illustrates a schematic diagram of Embodiment 2 in the present disclosure.

Figure 5:
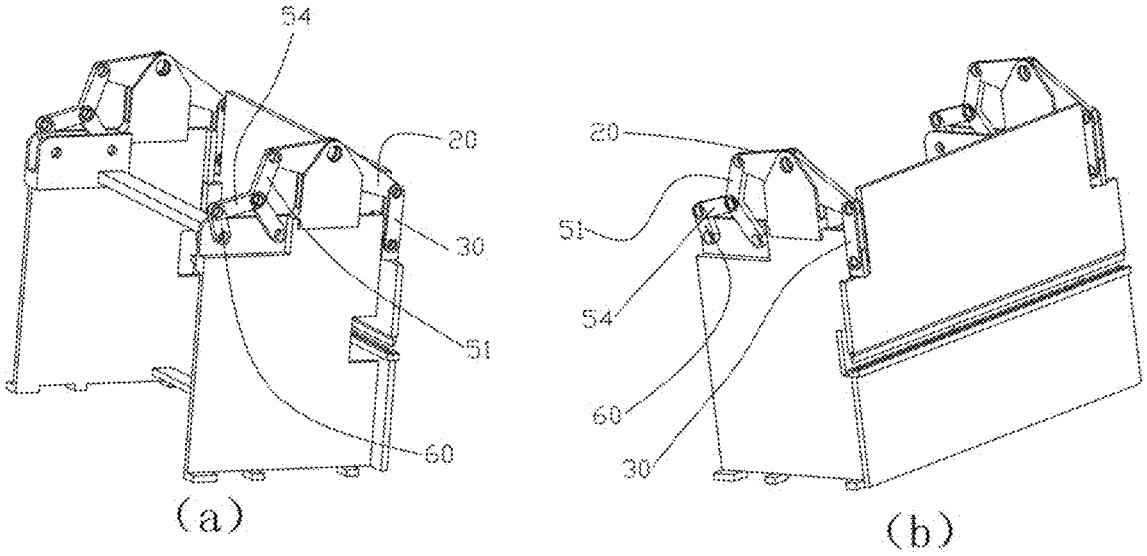

FIG. 5 illustrates a structural stereogram of Embodiment 3 in the present disclosure, (a) of FIG. 5 illustrates a three-dimensional view 1, and (b) of FIG. 5 illustrates a three-dimensional view 2.

Figure 6:
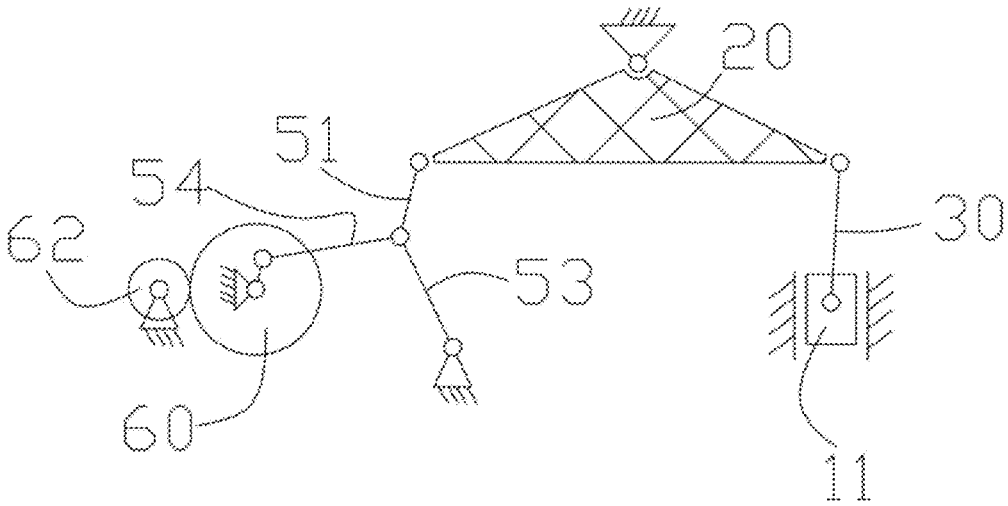

FIG. 6 illustrates a schematic diagram of Embodiment 3 in the present disclosure.

Figure 7:
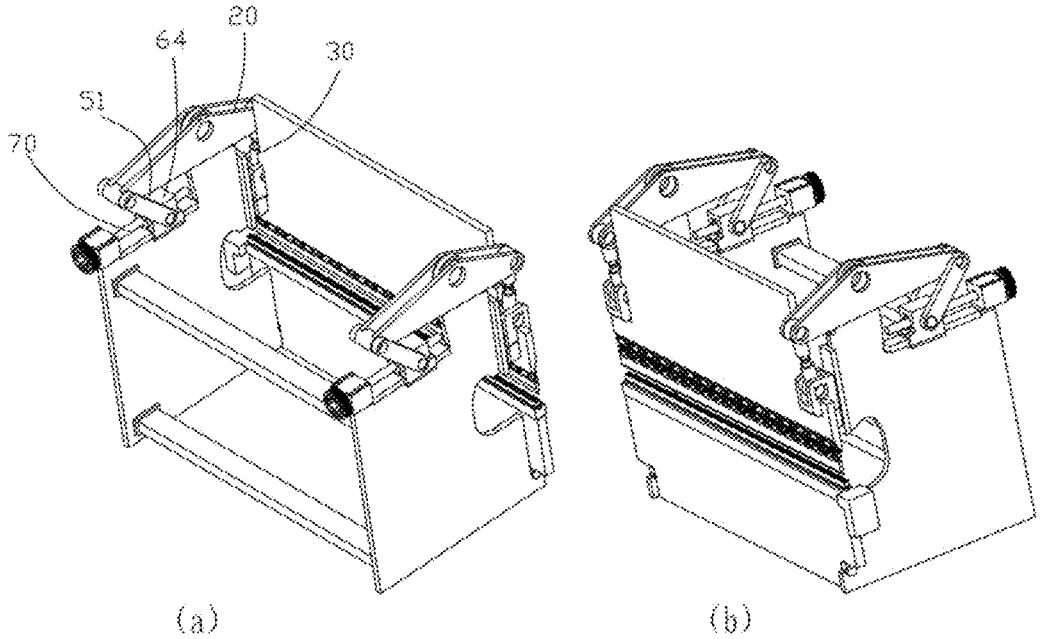

FIG. 7 illustrates a structural stereogram of Embodiment 4 in the present disclosure, (a) of FIG. 7 illustrates a three-dimensional view 1, and (b) of FIG. 7 illustrates a three-dimensional view 2.

Figure 8:
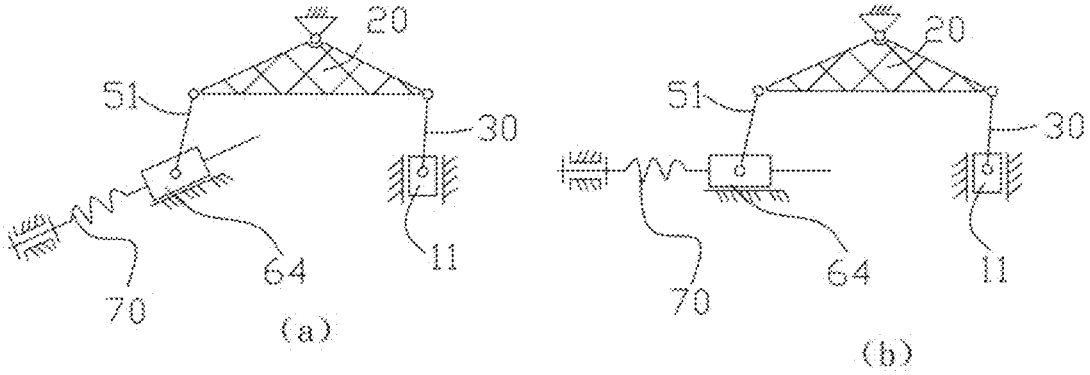

FIG. 8 illustrates a schematic diagram of Embodiment 4 in the present disclosure; (a) of FIG. 8 illustrates a schematic diagram when a sliding block is in an inclined state, and (b) of FIG. 8 illustrates a schematic diagram when the sliding block is in a horizontal state.

Figure 9:
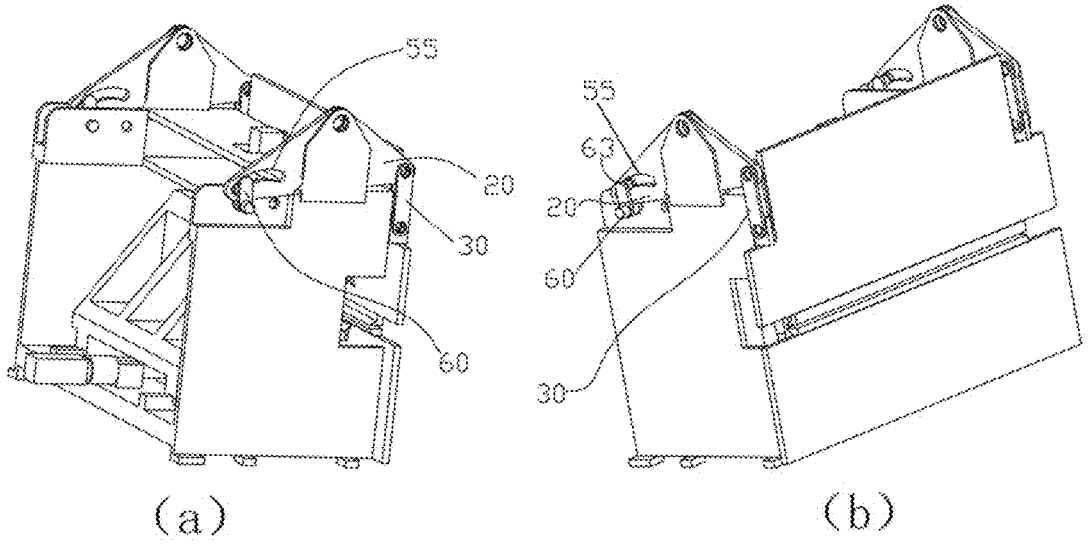

FIG. 9 illustrates a structural stereogram of Embodiment 5 in the present disclosure, (a) of FIG. 9 illustrates a three-dimensional view 1, and (b) of FIG. 9 is a three-dimensional view 2.

Figure 10:
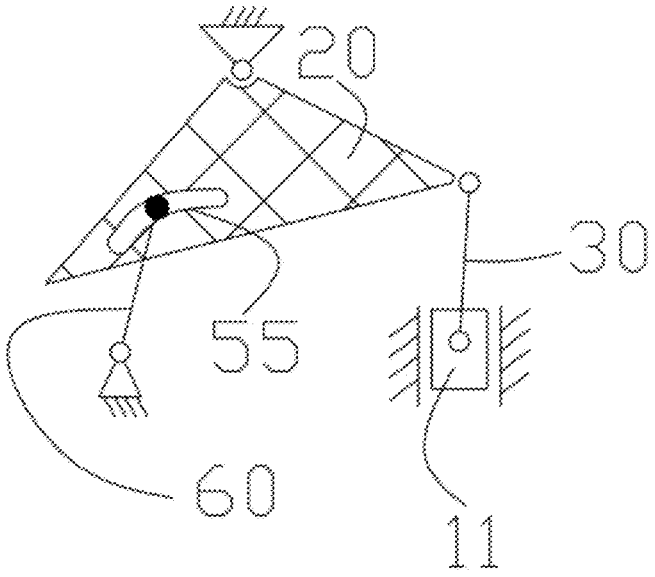

FIG. 10 illustrates a schematic diagram of Embodiment 5 in the present disclosure.

Figure 11:
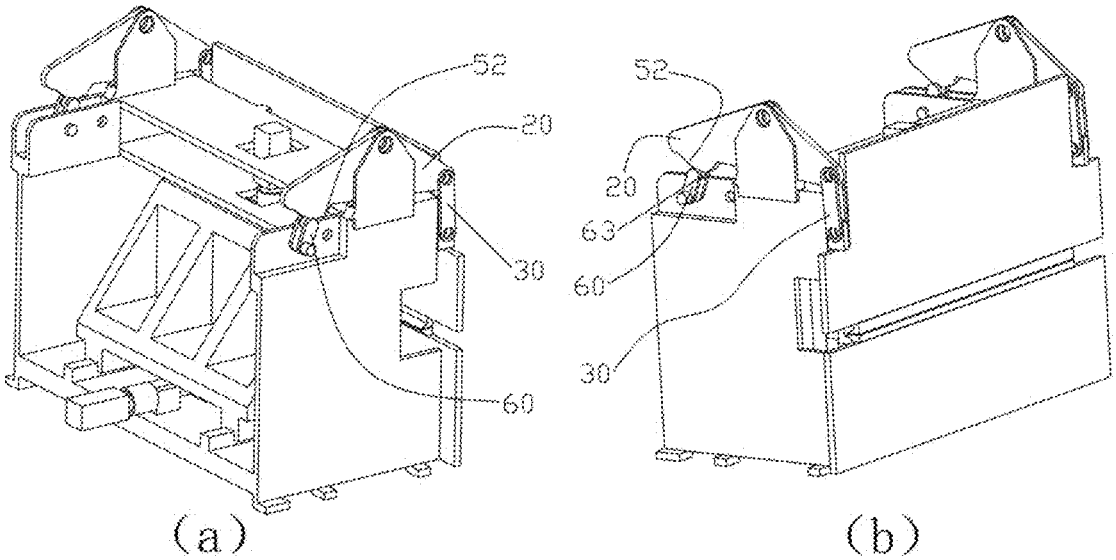

FIG. 11 illustrates a three-dimensional view of Embodiment 6 in the present disclosure, (a) of FIG. 11 illustrates a three-dimensional view 1, and (b) of FIG. 11 illustrates a three-dimensional view 2.

Figure 12:
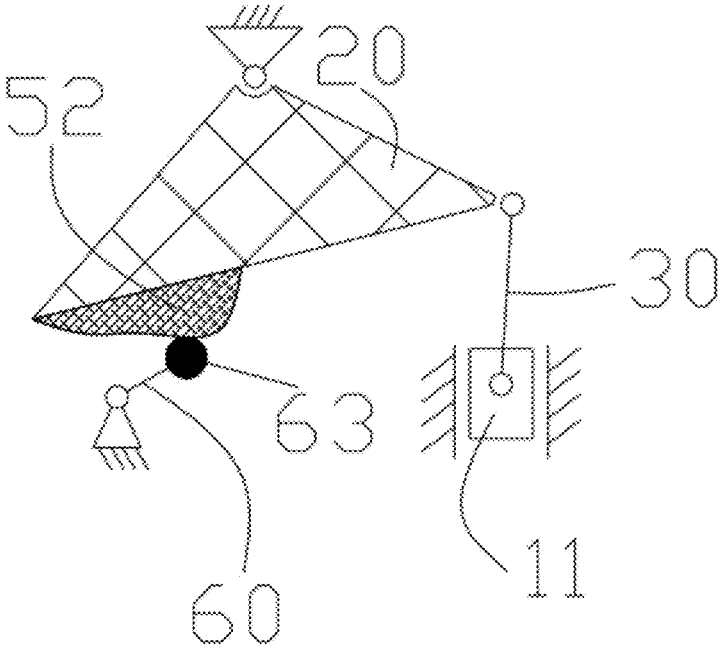

FIG. 12 illustrates a schematic diagram of Embodiment 6 in the present disclosure.

Figure 13:
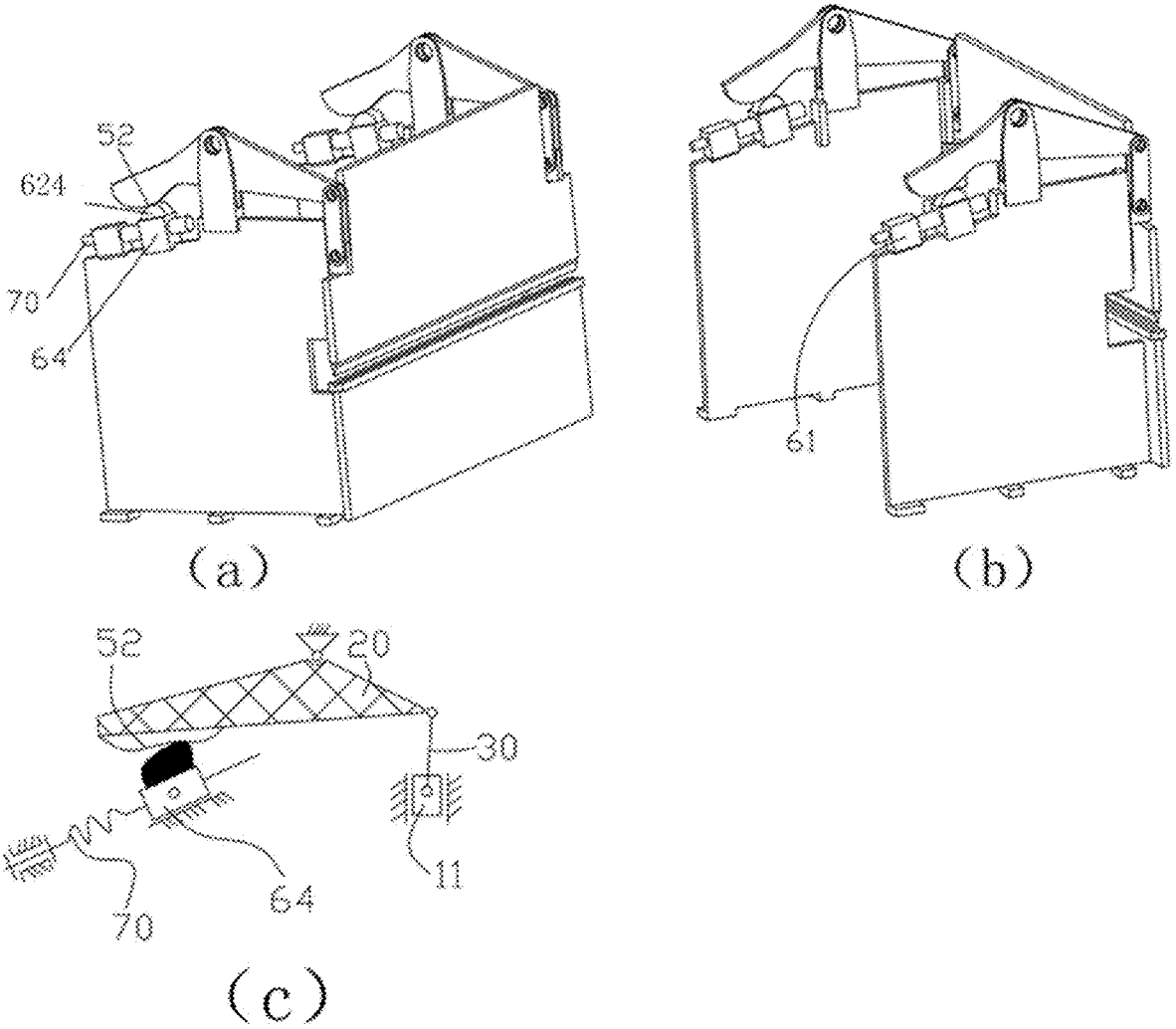

FIG. 13 illustrates a structural stereogram and a schematic diagram of Embodiment 7 in the present disclosure, (a) of FIG. 13 illustrates a three-dimensional diagram 1, (b) of FIG. 13 illustrates a three-dimensional diagram 2, and (c) of FIG. 13 illustrates a schematic diagram.

Figure 14:
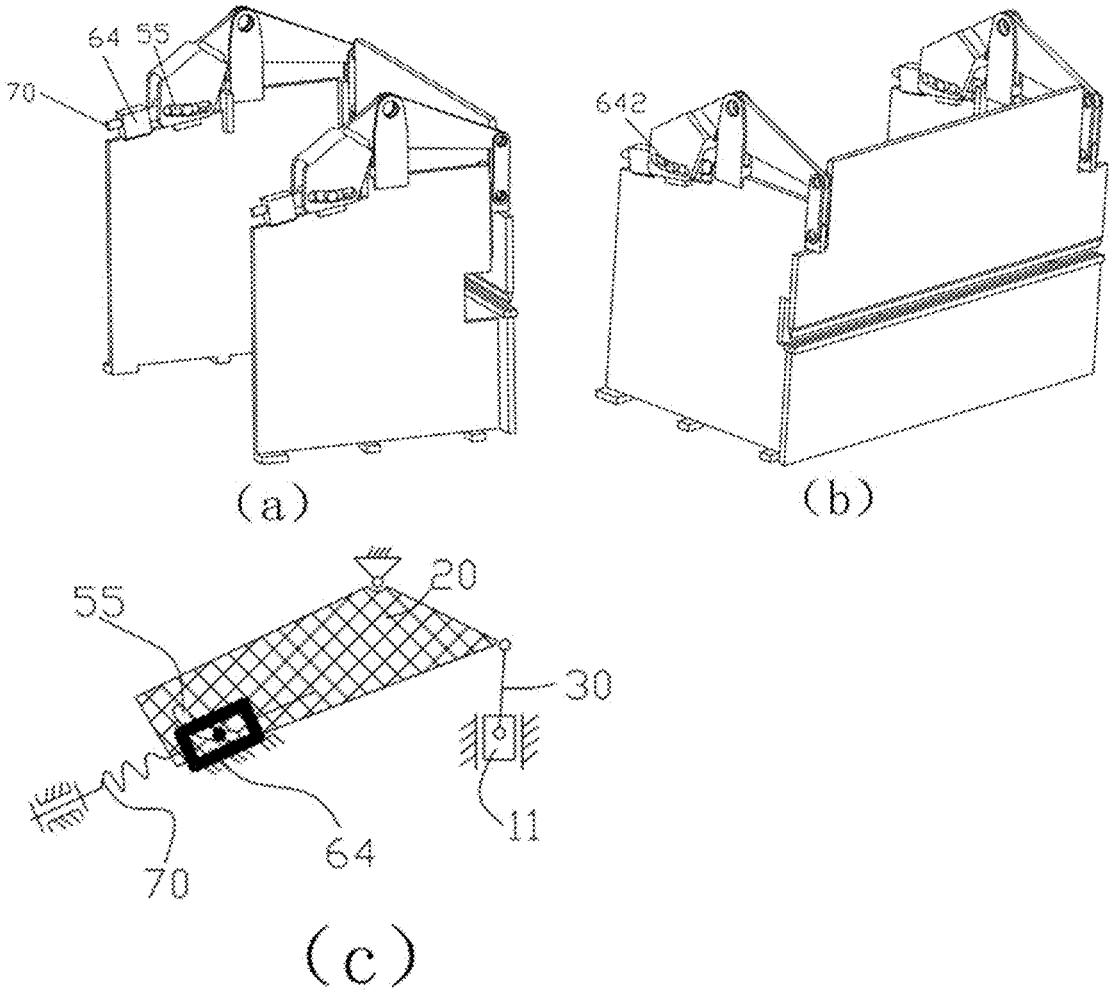

FIG. 14 illustrates a structural stereogram and a schematic diagram of Embodiment 8 of the present disclosure, (a) of FIG. 14 illustrates a three-dimensional diagram 1, (b) of FIG. 14 illustrates a three-dimensional diagram 2, and (c) of FIG. 14 illustrates a schematic diagram.

Figure 15:
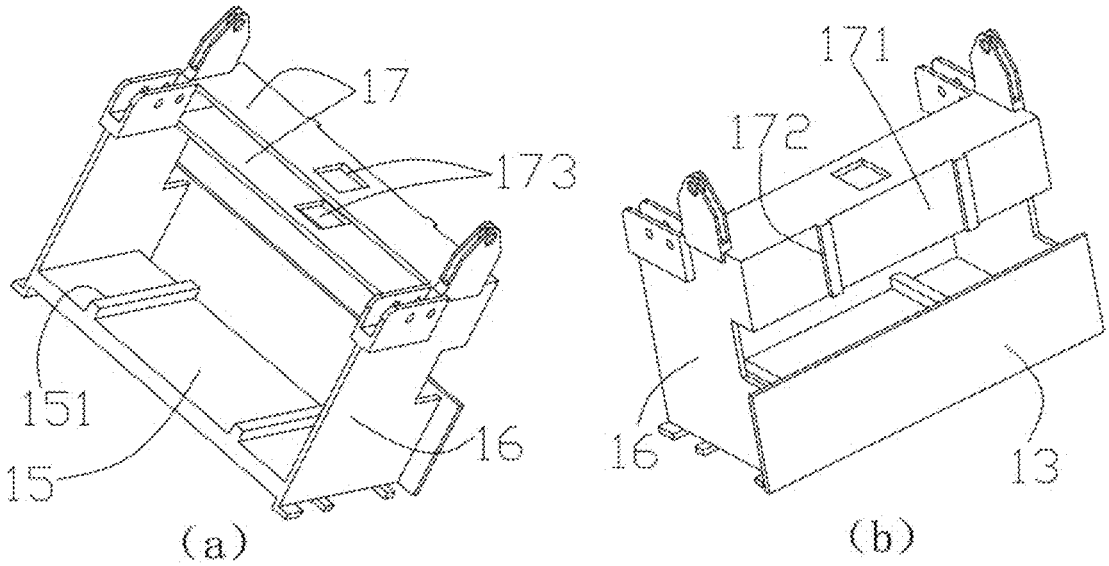

FIG. 15 illustrates a structural stereogram of a rack without a horizontal driving seat in the present disclosure, (a) of FIG. 15 illustrates a three-dimensional view 1, and (b) of FIG. 15 illustrates a three-dimensional view 2.

Figure 16:
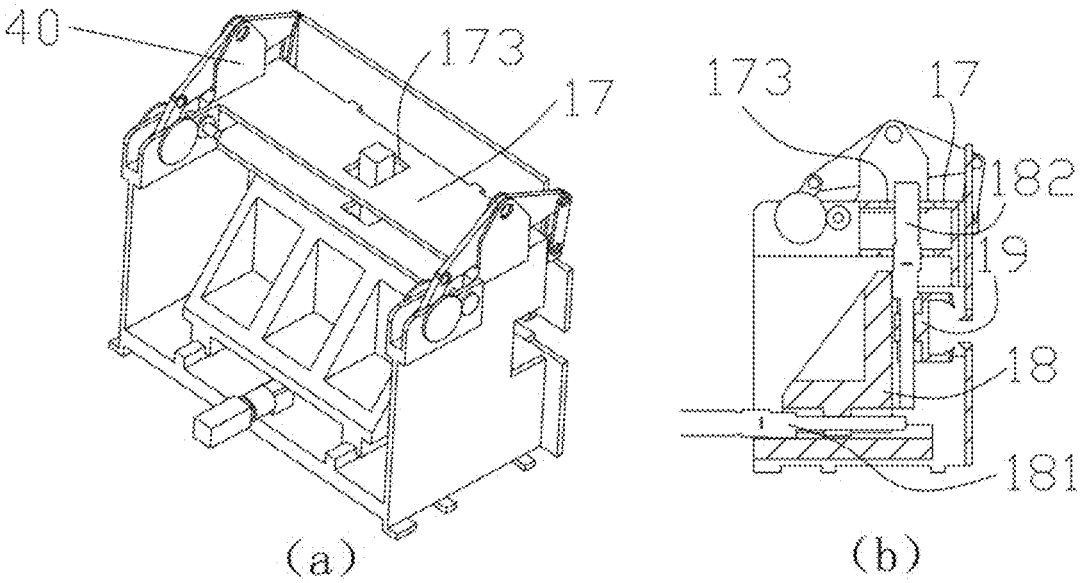

FIG. 16 illustrates a structural stereogram and a cross-sectional view of a rack with a horizontal driving seat in the present disclosure, (a) of FIG. 16 illustrates a stereogram, and (b) of FIG. 16 is a cross-sectional view.

Figure 17:
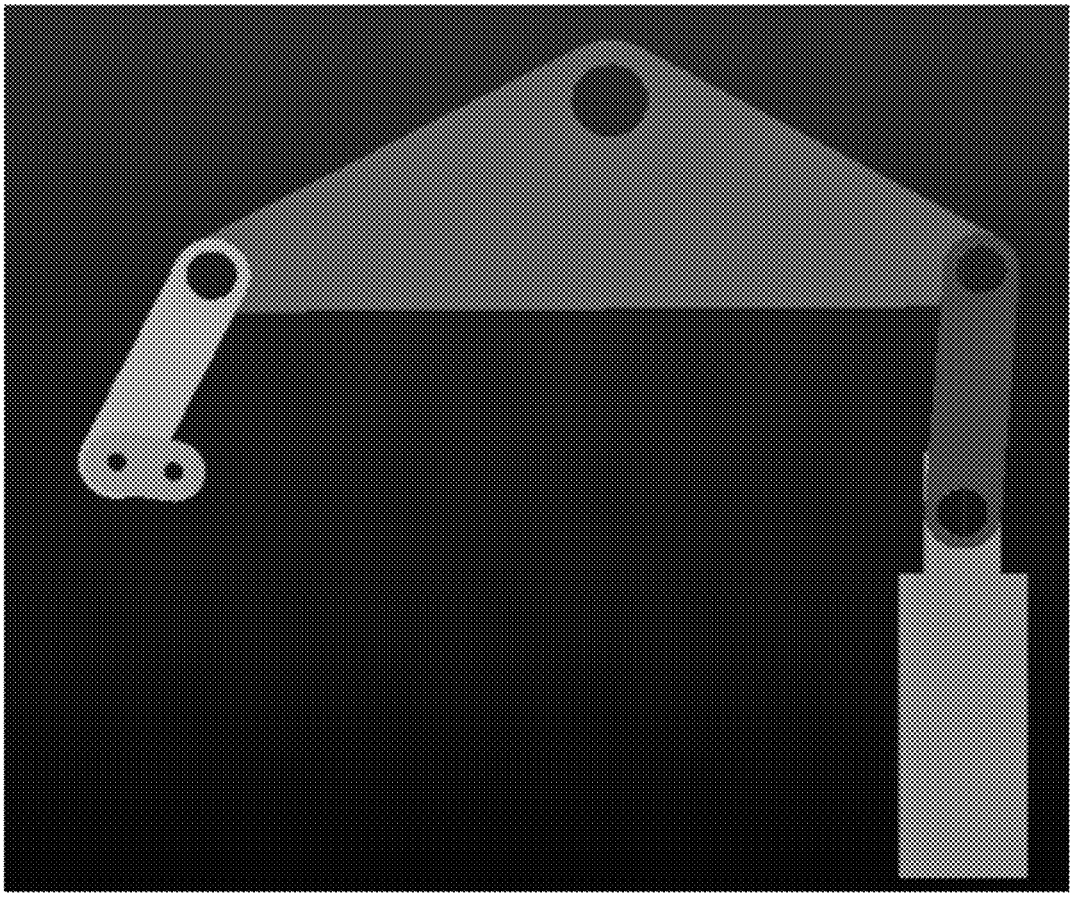

FIG. 17 illustrates a kinematics simulation model in the present disclosure.

Figure 18:
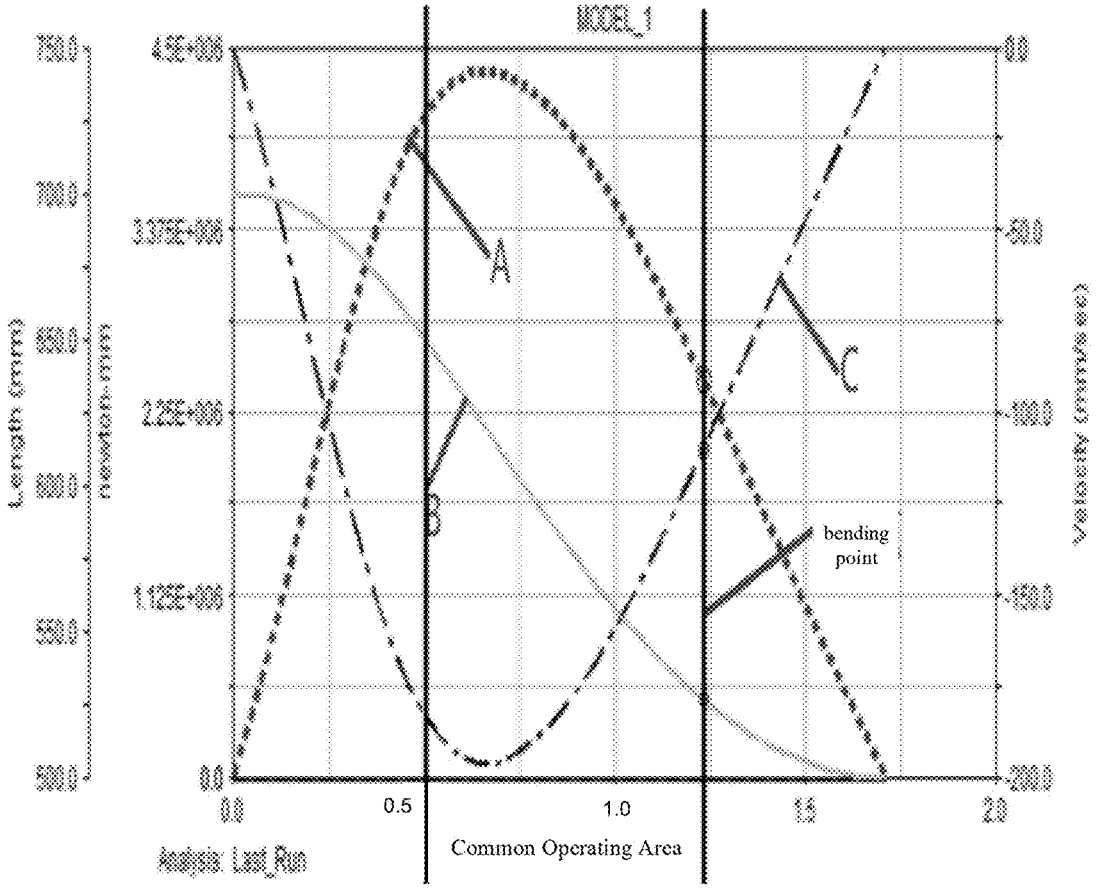

FIG. 18 illustrates a simulation result in the present disclosure.

Figure 19:
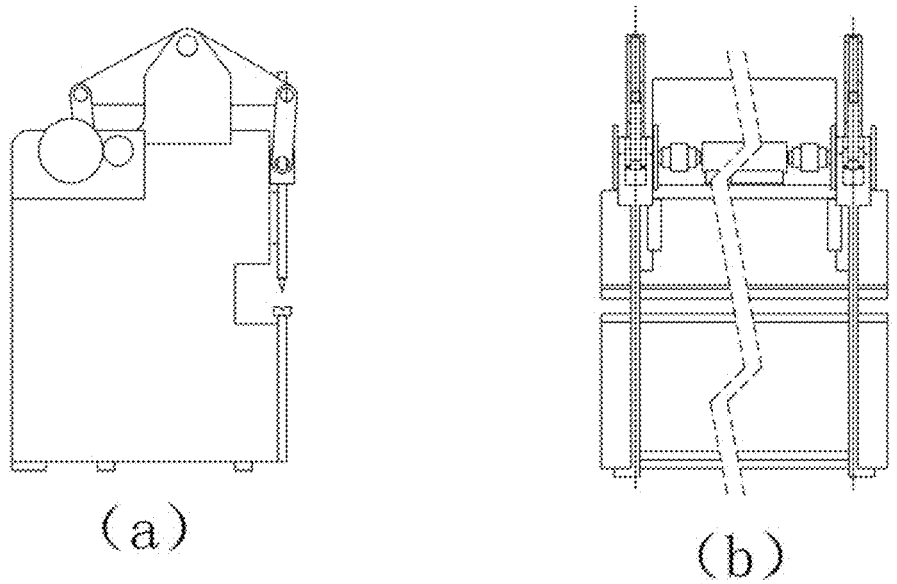

FIG. 19 illustrates a schematic diagram of a symmetrical arrangement of middle-layer planes on two side plates of the rack in the present disclosure.

Figure 20:
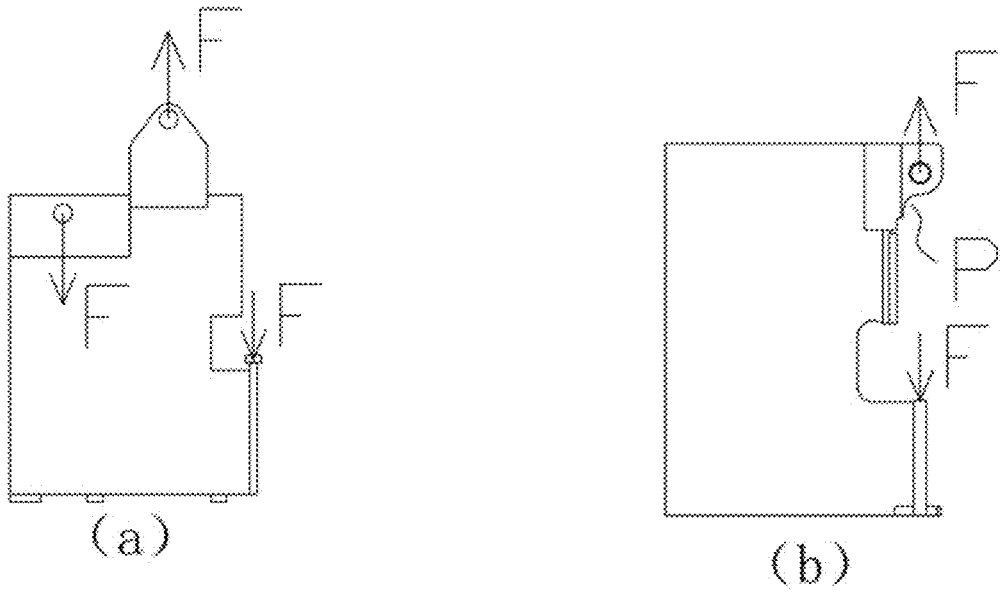

Parts (a) and (b) of FIG. 20 illustrates a schematic diagram of a force-bearing of the rack in the present disclosure.

Figure 21:
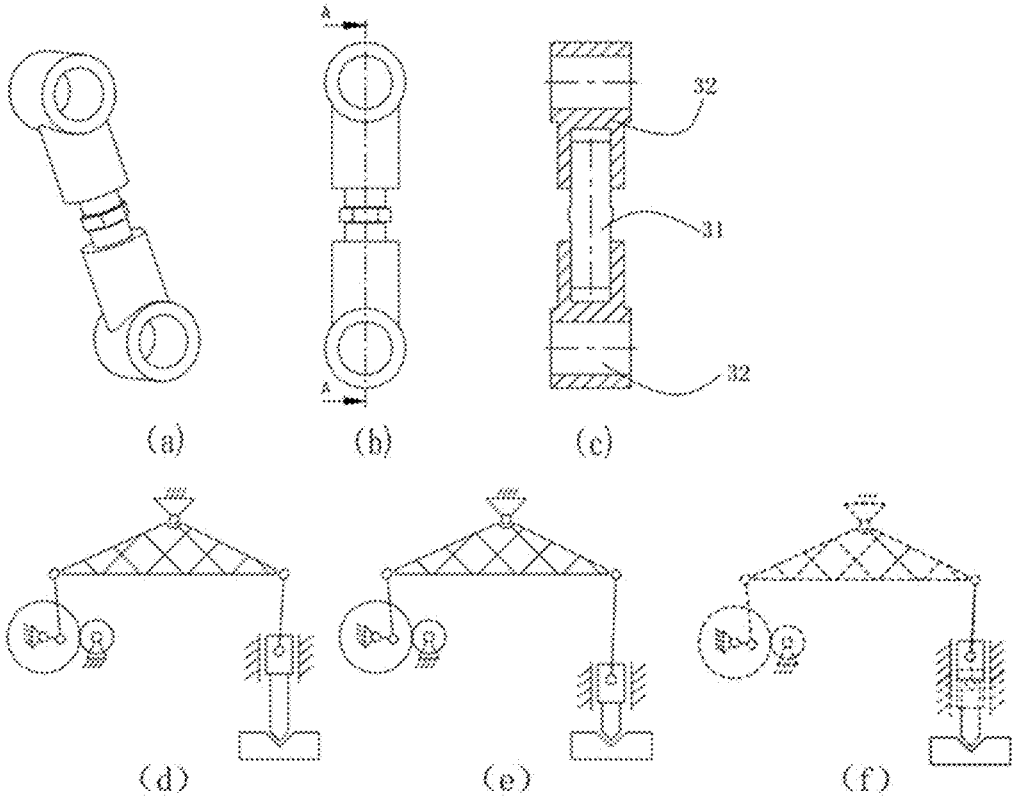

FIG. 21 illustrates a structural diagram and a telescopic principle diagram of a connecting rod in the present disclosure; (a) of FIG. 21 illustrates a three-dimensional view of the connecting rod, (b) of FIG. 21 illustrates a front view 2 of the connecting rod, (c) of FIG. 21 illustrates an A-A cross-sectional view of (b) of FIG. 21, (d) of FIG. 21 illustrates a schematic diagram of the connecting rod in a normal state, (e) of FIG. 21 illustrates a schematic diagram of the connecting rod in an extended state, and (f) of FIG. 21 illustrates a schematic diagram of the connecting rod in a compression state.

Figure 22:
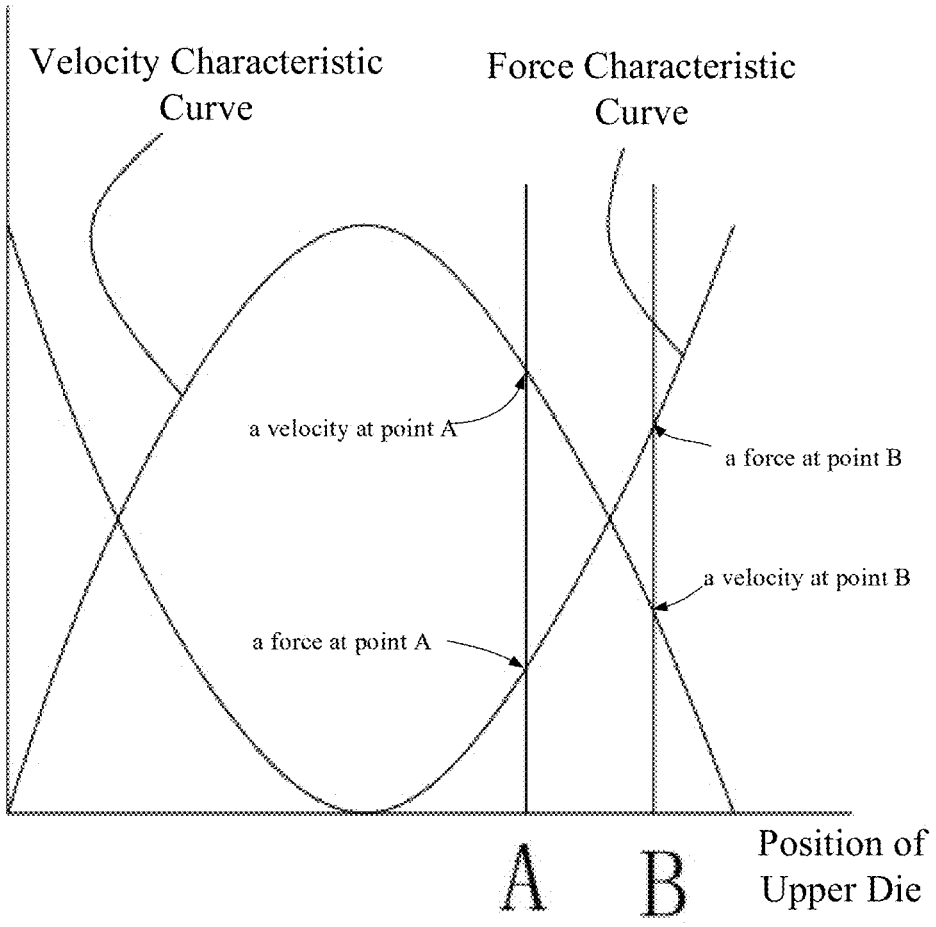

FIG. 22 illustrates a curve diagram of velocity characteristic and a curve diagram of force characteristic when the length of the connecting rod is adjustable in the present disclosure.

Figure 23:
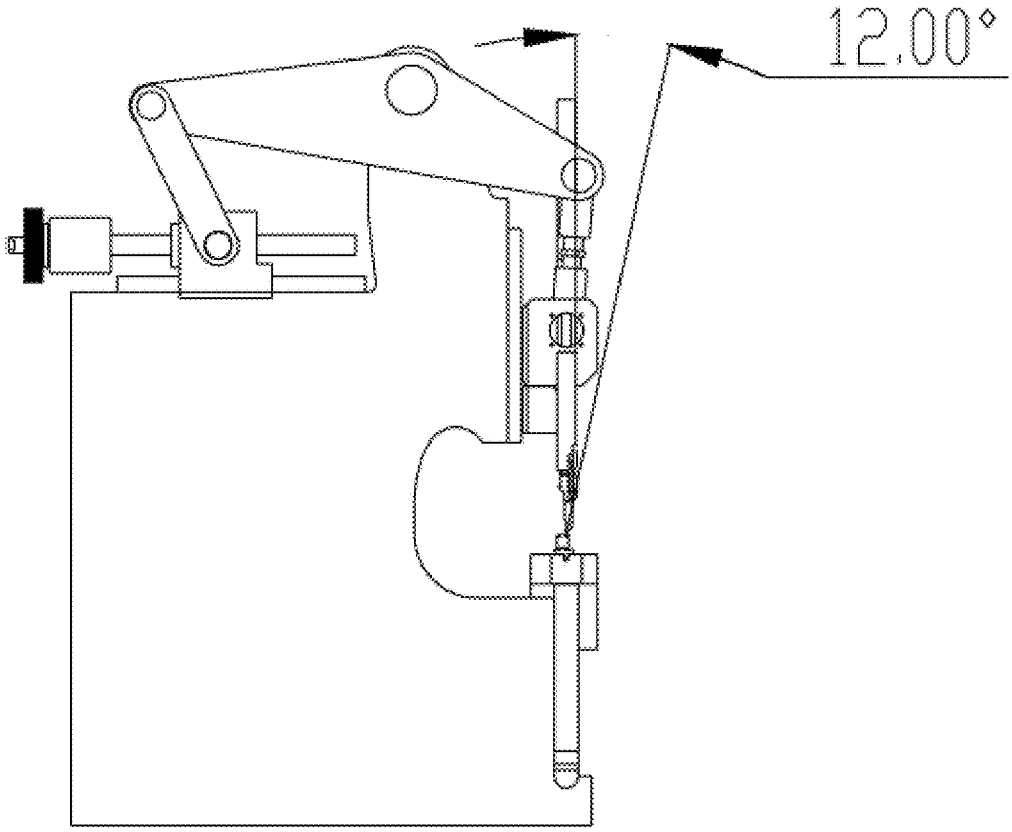

FIG. 23 illustrates a schematic diagram of a small-angle bending in Embodiment 4 of the present disclosure.

Figure 24:
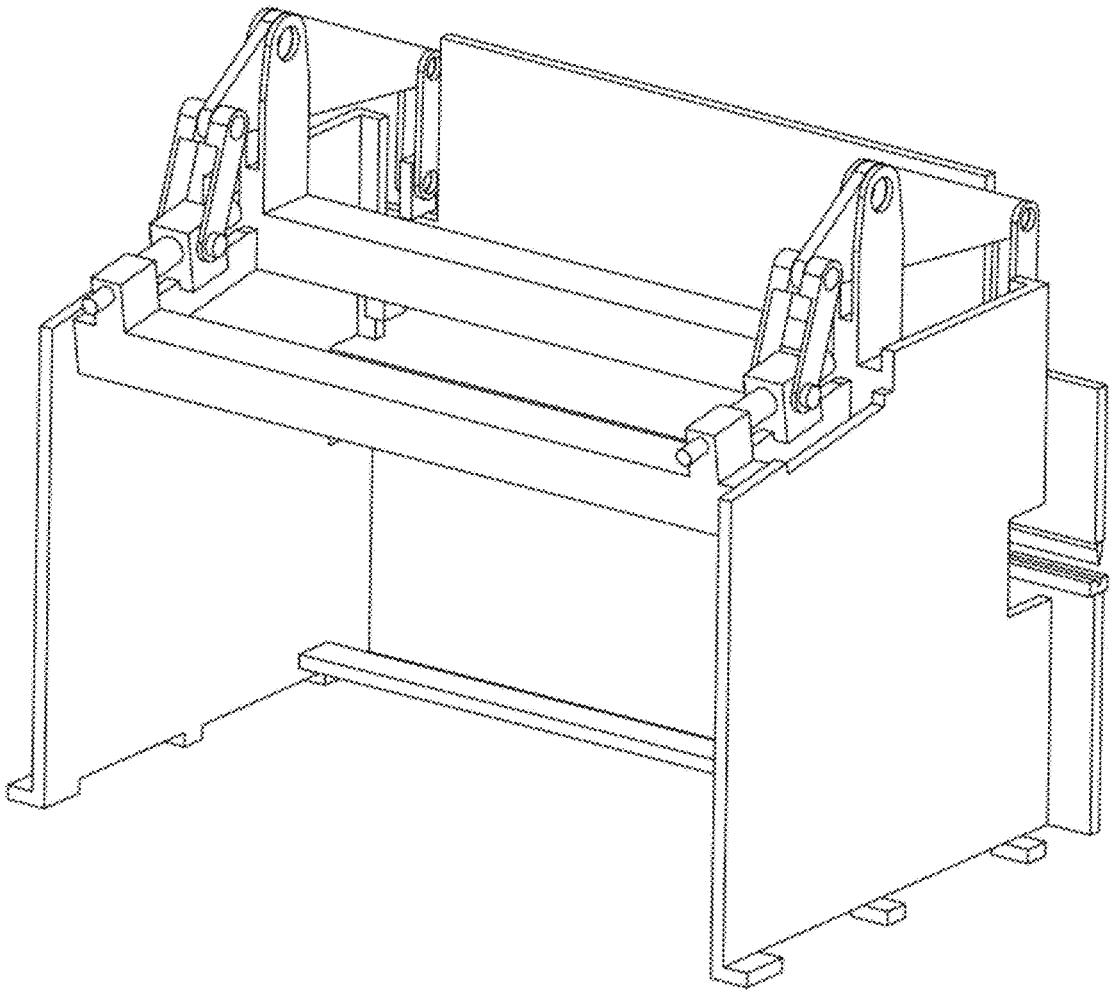

FIG. 24 illustrates a schematic diagram of the pressing arm installed on a top part of the rack (being not symmetrically arranged relative to the middle-layer plane of the side plate) in Embodiment 4 of the present disclosure.

Figure 25:
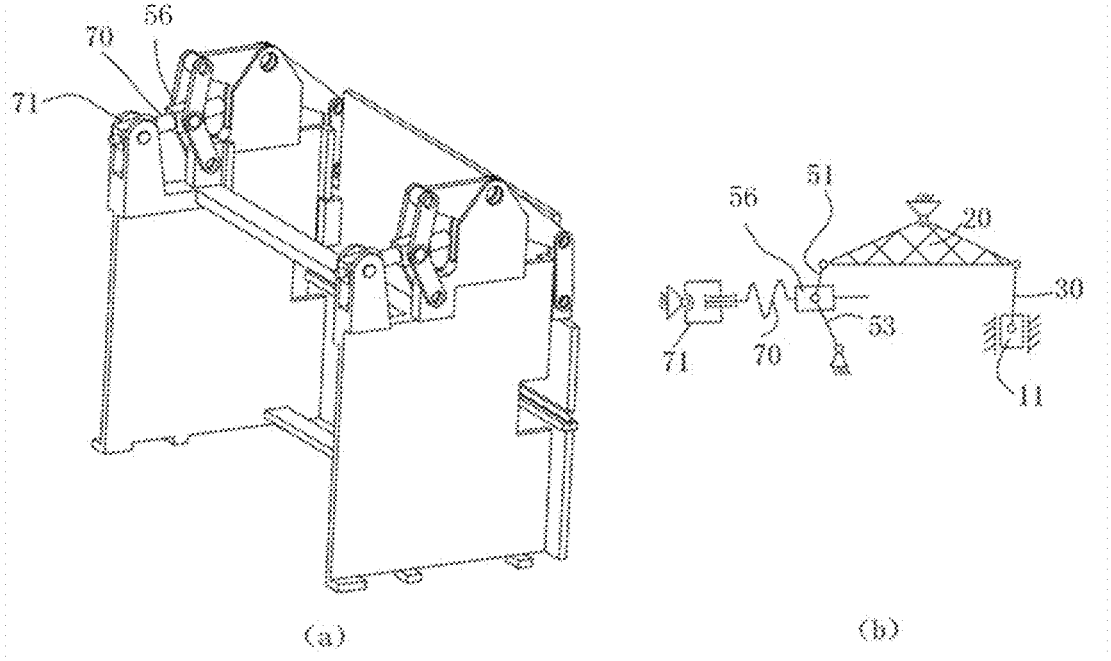

FIG. 25 illustrates a structure diagram and a schematic diagram of Embodiment 9 in the present disclosure, (a) of FIG. 25 illustrates a structure diagram, and (b) of FIG. 25 illustrates a schematic diagram.

Figure 26:
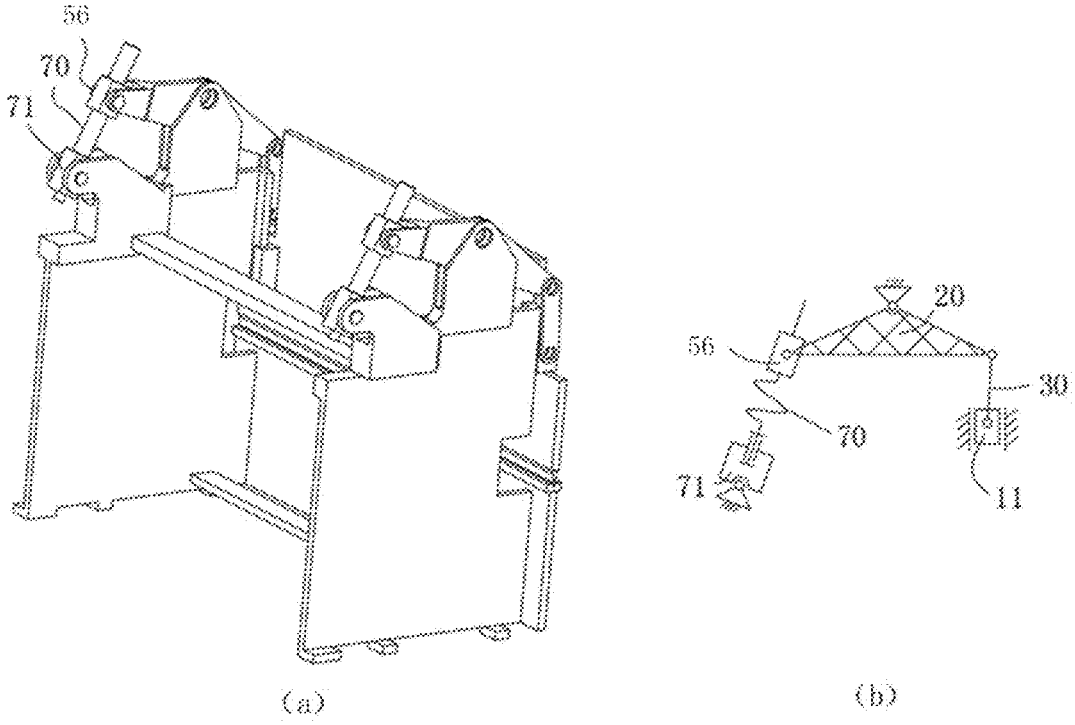

FIG. 26 illustrates a structure diagram and schematic diagram of Embodiment 10 in the present disclosure, (a) of FIG. 26 illustrates a structure diagram, and (b) of FIG. 26 illustrates a schematic diagram.

DETAILED DESCRIPTION OF THE EMBODIMENTS

The present disclosure will be further described in detail below with reference to the accompanying drawings and the specific preferred embodiments.

In the description of the present disclosure, it should be understood that the orientation or positional relationships indicated by the terms "left", "right", "upper", "lower", and the like, are based on the orientation or positional relationships illustrated in the accompanying drawings, and only for the convenience of describing the present invention and simplifying the description, rather than indicating or implying that the referred devices or elements must have a particular orientation, and be constructed and operated in a particular orientation. The "first", "second" and the like, do not indicate the importance of the components, and therefore cannot be construed as the limitations to the present disclosure. The specific dimensions used in these embodiments are only for illustrating the technical solutions, and do not limit the protection scope of the present disclosure. In addition, based on the principles of the transmission mechanism in the present disclosure, modifications of size of each component, the hinging position and the number of components all fall within the protection scope of the present disclosure.

Figure 1:
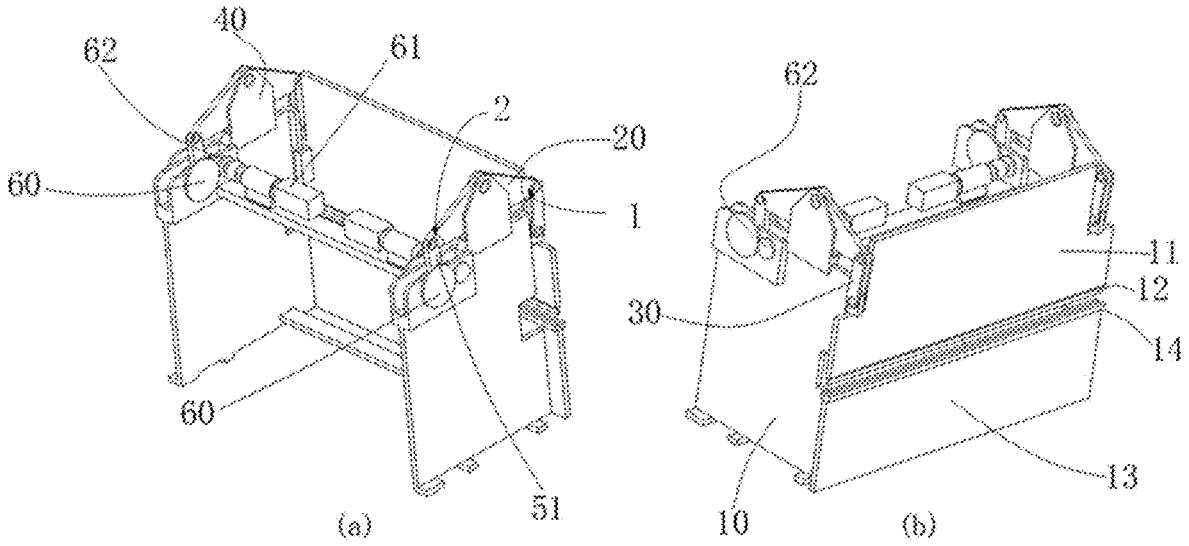
FIG. 1 illustrates a structural stereogram of Embodiment 1 in the present disclosure, (a) of FIG. 1 is a three-dimensional view 1, and (b) of FIG. 1 is a three-dimensional view 2.

As illustrated in FIG. 1, the metal sheet bending equipment includes a rack 10, an upper cross beam 11, an upper die 12, a lower cross beam 13 and a lower die 14.

As illustrated in FIG. 15 and FIG. 16, when the metal sheet bending equipment is a bending center, the rack includes a bottom plate 15, side plates 16, a reinforcing plate 17, an upper vertical plate 171, a horizontal driving seat 18, a C-shaped beam 19 and an upper cross beam lifting driving device.

The two side plates are parallel to each other and symmetrically arranged on the left and right sides of the bottom plate.

The number of the reinforcing plate is at least one, in the present disclosure, the number of the reinforcing plates is preferably two, which are arranged in parallel and configured to connect top parts of the two side plates, and an intermediate part of each reinforcing plate is provided with an avoidance hole 173.

The upper vertical plate is vertically and fixedly installed at the front ends of all the reinforcing plates. The front panel of the upper vertical plate is preferably provided with upper and lower guiding tracks 172. The upper cross beam is located between both sides of the upper vertical plate, and is slidably installed on the upper and lower guiding tracks, and is ascended or descended vertically along the upper vertical plate driven by the upper cross beam lifting driving device.

The arrangement of the above-mentioned reinforcing plates is capable of ensuring the rigidity of the entire machine and greatly improves the machining accuracy. When the bending equipment is the bending center, due to the vertical driving components occupy the space, for the motor, the reducer and other components extended out by the vertical driving component, the C-shaped beam needs to be installed onto the rack before installing the horizontal moving seat. However, the C-shaped beam is too heavy to be hoisted and requires a special tooling for installation. In order to solve the problems of processing and assembling technologies, the products of some companies even adopt a split body, which seriously affects the accuracy and rigidity of the entire machine. Whereas, the avoidance holes provided in the present disclosure are capable of configuring to avoid the vertical driving components, and the number of the avoidance holes is equal to the number of the driving components, preferably 1 set or 2 sets.

The top surface of the bottom plate is provided with front and rear guiding tracks 151, and the horizontal driving seat is slidably installed on the front and rear guiding tracks, and is capable of sliding back and forth along the front and rear guiding tracks driven by the horizontal driving component 181, and a vertical driving component 182 is installed at the front end of the horizontal driving seat, the top end of the vertical driving component is protruded from the avoidance hole and is capable of sliding back and forth in the avoidance hole.

The above-mentioned C-shaped beam is installed on the vertical driving component, so that the front-rear and up-down sliding of the C-shape beam can be implemented.

The above-mentioned upper cross beam lifting driving device is also a heavy-load and high-precision transmission mechanism applicable to metal sheet bending equipment of the present disclosure.

When the metal sheet bending equipment is a bending machine, the rack only requires to include the side plates 16 and the upper cross beam lifting driving device, and the reinforcing plates and the avoidance holes are not required to be arranged.

As illustrated in FIG. 1 to FIG. 14, a heavy-load and high-precision transmission mechanism applicable to metal sheet bending equipment includes pressing arms 20, connecting rods 30, hinged supports 40, pressing arm lifting assemblies and pressing arm lifting driving assemblies.

Each of the above-mentioned pressing arms is equivalent to a lever, which takes the hinged support as a fulcrum. The pressing arm lifting driving assembly drives the pressing arm lifting assembly to ascend or descend, so that the pressing arm is rotated or swung up and down to drive the connecting rod to move, thus driving the upper cross beam to move up and down. Meanwhile, the force-bearing point of the rack is capable of being transferred to the position of the hinged support, which greatly improves the rigidity and strength of the rack, and is extremely important for the large-tonnage all-electric servo driving.

Further, the pressing arms have two, which are symmetrically arranged on the top parts of both sides of the rack, and preferably arranged on the top parts of the two side plates. In order to improve strength and rigidity, each pressing arm is arranged in a shape of being high in the middle and low on the both sides, and in this embodiment, a triangle with a top corner, a bottom corner 1 and a bottom corner 2 is preferred. The top corner faces upwards, and the bottom corner 1 faces the upper cross beam, that is, the top corner is located on a connecting line of the two bottom corners. As an alternative, the top corner can also be located under the connecting line. The length of the bottom edge of the pressing arm is preferably shorter than the length of the side plate. As an alternative, the pressing arm can also be other known shapes such as a curved plate.

The present disclosure will be described in detail below with eight preferred embodiments.

Embodiment 1

As illustrated in FIG. 1 and FIG. 2, the front end part of each pressing arm facing the upper cross beam (that is, the bottom corner 1) is hinged with the upper end of the connecting rod, and the lower end of the connecting rod is hinged with the upper cross beam.

The intermediate part (that is, the top corner) of each pressing arm is hinged on the rack correspondingly through the hinged support, preferably hinged on the side plate.

The rear end part (that is, the bottom corner 2) of each pressing arm is provided with a set of pressing arm lifting assemblies, and each set of pressing arm lifting assemblies is connected to at least one set of pressing arm lifting driving assemblies.

The number of sets of the pressing arm lifting driving assemblies is selected according to the load weight. When the load weight is a small tonnage, one set of driving is selectable, and when the load weight is a super large tonnage, a plurality of sets of drivings are selectable, preferably two sets.

In this embodiment, the pressing arm lifting assembly is preferably a pressing rod 51.

In this embodiment, the pressing arm lifting driving assembly includes a crankshaft 60, an all-electric servo motor 61 and a pinion 62.

The crankshaft referred to in the present disclosure can also be equivalent to the similar components such as a crank or an eccentric wheel. In this Embodiment 1, the crankshaft is preferably a crank, and an outer circumference of the crank is provided with external teeth.

The all-electric servo motor 61 is preferably connected with a central shaft of the pinion through a reduction box and a coupling and the like, so as to drive the pinion to rotate. The pinion is engaged with the external teeth of the crankshaft. The crankshaft (crank, can also be eccentric) is hinged with the bottom end of the pressing rod, and the top end of the pressing rod is hinged with the rear end part of the pressing arm.

Further, the above-mentioned hinged supports, connecting rods, pressing rods, and pressing arms are preferably arranged symmetrically with respect to the corresponding side plates. As an alternative, the symmetrical arrangement that is not relative to the side plate also falls within the protection scope of the present disclosure.

This Embodiment 1 is an optimal combination with reference to the factors such as manufacturing process, mechanical properties, kinematic properties and costs, which is commonly applicable to the heavy load transmission within the range from 63 tons to 250 tons, and the specific transmission principles are as illustrated in FIG. 2.

Embodiment 2

As illustrated in FIG. 3 and FIG. 4, the front end part (that is, the bottom corner 1) of each pressing arm facing the upper cross beam is hinged with the upper end of the connecting rod, and the lower end of the connecting rod is hinged with the upper cross beam.

The rear end part (that is, the bottom corner 2) of each pressing arm is hinged on the rack correspondingly through the hinged support, preferably hinged on two side plates of the rack.

The intermediate part (that is, the top corner) of each pressing arm is provided with a set of pressing arm lifting assemblies, and each set of pressing arm lifting assemblies is connected with a set of pressing arm lifting driving assemblies.

In this Embodiment 2, the pressing arm lifting assembly is preferably the pressing rod 51.

In this Embodiment 2, the pressing arm lifting drive assembly includes a crankshaft 60 and an all-electric servo motor 61. The crankshaft can be an equivalent component such as a crank or an eccentric wheel. One end of the crankshaft is connected with the all-electric servo motor 61 and is rotated driven by the all-electric servo motor 61. The other end of the crankshaft is hinged with the bottom end of the pressing arm, and the top end of the pressing arm and the top corner of the pressing arm are hinged with each other.

In this Embodiment 2, the intermediate hinging point is adopted for driving, which is more suitable for high-velocity occasions.

The hinging point of the pressing arm located at the rear end is also applicable to other embodiments, and the pressing arm lifting assembly arranged on the intermediate part also falls within the protection scope of the present disclosure.

Embodiment 3

Embodiment 3 is basically similar to Embodiment 1, the differences lie in the differences of the pressing arm lifting assembly.

As illustrated in FIG. 5 and FIG. 6, in addition to the pressing rod 51, each set of the pressing arm lifting assemblies further includes a pushing rod 54 and a supporting rod 53. The top end of the pushing rod is hinged with the bottom end of the pressing rod, and the bottom end of the pushing rod is hinged with the crankshaft. A supporting rod is further hinged at a hinging point between the pushing rod and the pressing rod, and the other end of the supporting rod is hinged on the rack correspondingly, preferably hinged on the corresponding side plate.

This Embodiment 3 has a larger and optimal load capacity, which is applicable to a larger tonnage, such as a heavy load occasion of more than 250 tons, even to 800 tons or 1000 tons.

Embodiment 4

A heavy-load and high-precision transmission mechanism applicable to metal sheet bending equipment includes pressing arms 20, connecting rods 30, hinged supports 40, pressing arm lifting assemblies and pressing arm lifting driving assemblies.

The pressing arm lifting assembly is also preferably a pressing rod 51.

As illustrated in FIG. 7 and FIG. 8, each set of pressing arm lifting driving assemblies includes an all-electric servo motor, a screw rod 70 and a sliding block 64.

The all-electric servo motor is configured to drive the screw rod to rotate (it can also be decelerated by conventional transmission modes such as synchronous pulleys or reducers), the sliding block is threadedly sleeved at the front end of the screw rod, and the both sides of the sliding block are preferably hinged with the bottom end of the pressing rod, and the hinging point between the sliding block and the pressing rod preferably intersects perpendicularly with a rotation center line of the screw rod.

The above-mentioned screw rod is preferably a ball screw.

Sliding tracks (preferably arranged on top parts of side plates) are preferably arranged on upper top parts of the rack on both sides away from the upper cross beam, sliding blocks are slidably installed on the sliding tracks and the directions of the screw rods are in consistent with the sliding tracks.

Further, the above-mentioned sliding tracks are preferably arranged horizontally, which is convenient for processing and manufacturing. In order to obtain different mechanical properties, the sliding tracks can also be arranged in a certain inclined angle.

Further, in this embodiment, each pressing arm includes two pressing plates that are in parallel to each other and in a triangle shape, that is, each pressing plate is of a structure with a high middle and two low sides, so that the mechanical property of the pressing plate is better. As an alternative, the pressing arm can also be an integral welding part or a casting part, which is not limited to a specific shape, any shapes that play a corresponding function all fall within the protection scope of the present disclosure.

Further, as illustrated in FIG. 24, each pressing arm and the above-mentioned inclined sliding tracks are arranged on the top part of the rack instead of the top part of the side plate, which is also within the protection scope of the present disclosure.

The hinged support is fixedly installed on the rack, and preferably arranged integrally with the side plates. The preferred arrangement method is specifically as follows: a hinged hole is symmetrically opened on the top parts of the two side plates, and a hinged shaft is inserted in each hinged hole, top corners of the two pressing plates are hinged at both ends of each hinged shaft. The bottom parts of two pressing plates of each pressing arm can be welded integrally or arranged separately.

Further, the length of each connecting rod in Embodiment 4 is adjustable. As illustrated in FIG. 21, each connecting rod includes a screw 31 and two connecting lugs 32 threadedly connected to the upper and lower ends of the screw. The threads at the upper and lower ends of the screw are reversed, and the distance between the connecting lugs at both ends is adjustable by rotating the threads. The connecting lug located at the top end of the screw is configured to hinge with the pressing arm, and the connecting lug located at the bottom end of the screw is configured to hinge with the upper cross beam.

FIG. 22 illustrates a curve diagram of velocity characteristic and a curve diagram of force characteristic when the length of the connecting rod is adjustable in the present disclosure. In the case where the length of the connecting rod is different, the position where the upper die contacts the sheet is different, such as point A and point B. For example, when the connecting rod is relatively long, the upper die contact the sheet at point A, when the connecting rod is relatively short, the upper die contact the sheet at point B. However, the velocity characteristic and the force characteristic of points A and B are different, the velocity of point A is higher than that of point B, but the force output is less; and the velocity of point B is lower than that of point A, but the force output is higher than that of point B. The length of the connecting rod can be adjusted to adapt to different operating conditions.

In addition, as illustrated FIG. 8, because the distance between the hinging point a of the pressing arm (a hinging point of the pressing arm and the hinge support) and the hinging point b of the pressing arm (a hinge point of the pressing arm and the connecting rod) is relatively large, the swing angle of the corresponding connecting rod is smaller when the pressing arm swings to press down as specifically illustrated in FIG. 23, the bending angle is 12.5°. Therefore, the modifications of the length of the connecting rod has a relative little effect on the characteristics of the entire mechanism, so the connecting rod of the mechanism is suitable for being designed as a part with adjustable length and suitable for small-angle bending.

The advantages of Embodiment 4 are a simple structure, a low design difficulty, a simple kinematic inverse solution, a simple analysis on mechanical characteristics, and an easy implementation. When the angle of the screw rod is different, the kinematic characteristics and mechanical characteristics of the mechanism are different, which can be adjusted according to the actual use requirements.

Embodiment 5

As illustrated in FIG. 9 and FIG. 10, the front end of each pressing arm is hinged with the upper cross beam through the connecting rod, the intermediate part of each pressing arm is hinged on the corresponding side plate through a hinged support, and the rear end part of each pressing arm is preferably provided with an arc-shaped geneva wheel 55.

The pressing arm lifting driving assembly is a driving such as a crankshaft driving or a screw rod driving. In this Embodiment 5, the pressing arm lifting assembly is preferably a crankshaft driving. In this situation, the pressing arm lifting driving assembly includes a crankshaft and a crankshaft rotating driving device configured to drive the crankshaft to rotate, and a crankshaft sliding rod 63 that is slidable in the geneva wheel is provided at the top end of the crankshaft.

In this Embodiment 5, different mechanism kinematics and mechanical characteristic curves can be obtained according to the different geneva wheel curves, which has a great elastic and flexibility.

Embodiment 6

As illustrated in FIG. 11 and FIG. 12, the front end part of each pressing arm is hinged with the upper cross beam through a connecting rod, the intermediate part of each pressing arm is hinged on the corresponding side plate through a hinged support, and the rear end part of each pressing arm is preferably provided with a cam 52 protruding downward.

The pressing arm lifting driving assembly is a driving such as a crankshaft driving or a screw rod driving. In this Embodiment 6, the pressing arm lifting driving assembly is preferably a crankshaft driving. In this situation, the pressing arm lifting drive assembly includes a crankshaft and a crankshaft rotating driving device configured to drive the crankshaft to rotate. A crankshaft sliding rod 63 that is capable of slidable along the cam curve is provided at the top end of the crankshaft. In addition, the crankshaft sliding rod can be reset by using a spring.

In this Embodiment 6, different mechanism kinematics and mechanical characteristic curves can be obtained according to the different geneva wheel curves, which has a great elastic and flexibility.

Embodiment 7

As illustrated in FIG. 13, the front end part of each pressing arm is hinged with the upper cross beam through a connecting rod, the intermediate part of each pressing arm is hinged on the corresponding side plate through a hinged support, and the rear end part of each pressing arm is preferably provided with a cam 52 protruding downward.

The pressing arm lifting driving assembly of the pressing arm is a driving such as a crankshaft driving or a screw rod driving. In this Embodiment 7, the pressing arm lifting driving assembly is preferably a screw rod driving. In this situation, the pressing arm lifting driving assembly includes an all-electric servo motor, a screw rod and a sliding block. The all-electric servo motor is configured to drive the screw rod to rotate. The sliding block is threadedly sleeved at the front end of the screw rod. The top part of the sliding block is provided with an arc-shaped protrusion 624 that can match with the cam. In addition, the arc-shaped protrusion can be reset by using a spring.

Embodiment 8

As illustrated in FIG. 14, the front end part of each pressing arm is hinged with the upper cross beam through a connecting rod, the intermediate part of each pressing arm is hinged on the corresponding side plate through a hinged support, and the rear end part of each pressing arm is preferably provided with an arc-shaped geneva wheel 55.

The pressing arm lifting driving assembly is a driving such as a crankshaft driving or a screw rod driving. In this Embodiment 8, the pressing arm lifting driving assembly is preferably a screw rod driving. In this situation, the pressing arm lifting driving assembly includes an all-electric servo motor, a screw rod and a sliding block. The all-electric servo motor is configured to drive the screw rod to rotate. The sliding block is threadedly sleeved at the front end of the screw rod, and a sliding shaft 642 slidable in the geneva wheel is arranged on the sliding block.

Embodiment 9

As illustrated in FIG. 25, each set of pressing arm lifting assemblies further includes a connecting block 56 and a supporting rod 53. The bottom end of the pressing rod and the top end of the supporting rod are hinged with the connecting block, and the bottom end of the supporting rod is hinged on the rack.

The pressing arm lifting driving assembly further includes a screw rod 70 and a bearing seat 71. The bearing seat is hinged on the rack. The all-electric servo motor is installed in the bearing seat. The all-electric servo motor is configured to drive screw rod to rotate, and the connecting block is threadedly sleeved on the screw rod.

Embodiment 10

As illustrated in FIG. 26, the intermediate part of each pressing arm is hinged on the rack correspondingly through a hinged support, preferably hinged on the side plate. Each set of pressing arm lifting assemblies includes a connecting block 56 hinged on the rear end part of the corresponding pressing arm.

Each set of pressing arm lifting driving assemblies further includes a bearing seat 71 and a screw rod 70. The bearing seat is hinged on the rack. The all-electric servo motor is installed in the bearing seat. The all-electric servo motor is configured to drive the screw rod to rotate, and the connecting block is threadedly sleeved on the screw rod.

As an alternative, other forms of embodiments formed by combining any one of the pressing arm lifting assemblies in Embodiments 1 to 10 with any one of the pressing arm lifting driving assemblies in Embodiments 1 to 10 also belong to the protection scope of the present disclosure.

The present disclosure further has the following unique beneficial effects.

1. The all-electric servo motor replaces the traditional hydraulic, is energy conservation and environmentally friendly, which is calculated based on the market holdings of 50,000 units:

$$\frac{\text{saving eletric quantity}}{\text{year}} = 300\ \text{days} * \frac{16\ \text{hours}}{\text{working hours per day}} * \frac{4\ \text{kWh}}{\text{saving kWh per hour}} * 50{,}000\ \text{units} = 9.6 \times 10^8\ \text{kWh/year}$$

According to 3,333 kWh generated by per ton of coal, it is equivalent to saving coal for one year:

$$\frac{9.6 * 10^8}{3{,}333} = 288{,}029 = 289{,}000$$

tons of coal, the national coal consumption is 870 million tons, the above saving coal accounts for about 33,000 of the national coal consumption, which is pretty considerable.

The hydraulic oil is saved. The hydraulic oil for the hydraulic driving is replaced once a year, with a replacement quantity of approximate 300 L each time:

$$\frac{\text{saving hydraulic oil}}{\text{year}} = 300\ \text{L} * 50{,}000\ \text{units} = 15 \times 10^6\ \text{L/year.}$$

2. Since the nonlinear-motion characteristics of the mechanism, the mechanism is suitable for large tonnage: the same two 7.5 kw driving motors are adopted, the ordinary ball screw drives directly, which can only reach 30 to 40 tons. However, the mechanism provided in the present disclosure is capable of reaching the tonnage of 80 to 120 tons benefiting from the nonlinear characteristics of the mechanism under the same processing efficiency.

Simulation conditions: as illustrated in FIG. 17 and FIG. 18, A is the curve of the torque characteristic fed back by the motor, B is the curve of the position of the upper cross beam, and C is the curve of the velocity characteristic of the upper cross beam. The position of the bending point is approximately 20 mm from the bottom dead center. A fixed upward load is applied to the upper cross beam, and the crankshaft rotates at a constant velocity of 90.45 degrees.

It can be seen from the characteristic curve that the common operating area is between the two black lines. In the common operating area, before bending, there is an idle stroke, with the velocity gradually decreasing and the torque fed back by the motor gradually decreasing (this is consistent with the fact that the fixed torque is output by the motor, and the bending force output by the upper cross beam gradually increases), indicating a high velocity and low load condition; whereas, after the bending point, there is the low velocity and high load characteristics.

3. Because the force point of the rack is more reasonable, the strength and rigidity of the rack are better. Especially, when the transmission components are symmetrically arranged with respect to the center of the two side plates of the rack (symmetrical arrangement is preferred, but not limited), the two side plates of the rack are not subject to bending loads (the plate-shaped members are easily unstable when subjected to bending loads, which seriously affects the strength of the structure). Due to the limitation of the structural space, many mechanisms cannot be arranged with respect to the center of the two side plates. The side plates of the rack are subjected to twisting loads, which can easily cause the instability of the rack, and cannot guarantee the rigidity and strength.

As illustrated in FIG. 19 and FIG. 20, the force-bearing point of the rack is transferred to a position proximate to the middle position of the body through the pressing arm in the present disclosure, and no additional bending moment exists, therefore, the force-bearing of the structure is reasonable, no stress concentration point exists, and the rigidity is reliable; whereas the diagrams on the right sides in FIG. 19 and FIG. 20 illustrate schematic diagrams of the force-bearing of other existing racks with the force-bearing point on the side of the rack, "P" point is a stress concentration point, and noticeable stress concentration is easily to cause the static strength damage and the fatigue damage.

The rack and pressing arm are the most key parts. Since the pressing arm is laterally arranged on the upper part of the rack, the space layout is reasonable, and the pressing arm can be designed to be high in the middle and low at both ends (a triangle shape as mentioned above), which is not difficult to satisfy the rigidity and strength requirements of the structure, and is easier to achieve the structural design of the large tonnage machine tools.

4. The inverse kinematics solution is simpler and easier to be controlled: The inverse kinematics solutions is easier to be implemented, the explicit analytical solution can be obtained, the movement process can be precisely controlled, and the multiple iterations of the numerical solution is not required. The inverse kinematics solutions of the transmission mechanism, that is, according to the position required for the upper cross beam, the rotational angle of the driving motor is derived by the analytical method, which is the premise of realizing high dynamic characteristics and high precision control. However, due to the characteristics of the existing mechanism, there is no way to derive the analytical solution of the inverse kinematics solution, but it can only be derived by the numerical iteration. The control system of the existing mechanism requires a huge amount of calculation and consumes a large amount of control system resources, making it difficult to ensure the real-time and accuracy of the trajectory control of the control system, seriously affecting the velocity, and therefore cannot realize high dynamic characteristics and high-precision control.
5. The noise is low and no noise pollution exists.
6. The appearance is compact and more beautiful: the structure layout is reasonable, and the transmission components can be arranged inside the two side plates of the rack without protruding outside the rack, so that the appearance of the entire machine is more beautiful which improves the competitiveness of the product.
7. The length of the connecting rod is set to be adjustable, and the length of the connecting rod can be adjusted manually or automatically. As shown by points A and B of FIG. 22, when the length of the connecting rod is different, the position where the upper die contacts the sheet is different. For example, when the connecting rod is relatively long, the upper mold contacts the sheet is at point A, when the connecting rod is relatively short, the upper die contacts the sheet is at point B. The velocities and force characteristics of points A and B are different. The velocity of point A is higher than that of point B, but the force output is less; the velocity of point B is lower than that of point A, but the force output is higher than that of point B. When the small-sized and light-loaded metal sheets are bent, the connecting rod can be lengthened appropriately to achieve a higher velocity. Conversely, when the large-sized and heavy-loaded metal sheets are bent, the connecting rod can be shortened appropriately.
8. The layout of the mechanism is more reasonable, and the connecting rod and pressing arm protrude slightly from the front of the cross beam, so the mechanism can implement the small-angle bending of the large-format sheets without any collision interference between the sheet and the transmission mechanism. As illustrated in FIG. 23, the mechanism can implement the bending with the degree of 12*2=24 degrees, or even smaller.

The preferred embodiments of the present disclosure are described in detail above. However, the present disclosure is not limited to the specific details of the above-mentioned embodiments. Various equivalent transformations can be made to the technical solutions of the present disclosure within the scope of the technical concept of the present disclosure. These equivalent transformations all belong to the protection scope of the present disclosure.

What is claimed is:

1. A heavy-load and high-precision transmission mechanism applicable to metal sheet bending equipment, the heavy-load and high-precision transmission mechanism comprising pressing arms, connecting rods, hinged supports, pressing arm lifting assemblies and pressing arm lifting driving assemblies, wherein the metal sheet bending equipment includes a rack and an upper cross beam, the rack includes two side plates symmetrically arranged on both sides of the rack, a number of the pressing arms is two, and the two pressing arms are symmetrically arranged on upper parts of both sides of the rack, a front end part of each pressing arm facing the upper cross beam is hinged at a top end of the connecting rod, and a bottom end of the connecting rod is hinged with the upper cross beam, an intermediate part of each pressing arm or a rear end part of each pressing arm away from the upper cross beam is hinged on the hinged support, and the hinged support is fixedly installed or integrally arranged on the rack, the rear end part or the intermediate part of each pressing arm is provided with a set of pressing arm lifting assemblies, each set of pressing arm lifting assemblies is connected with at least one set of pressing arm lifting driving assemblies, and each set of pressing arm lifting driving assemblies includes an all-electric servo motor, and the pressing arm lifting assemblies are rotatable or slidable driven by a corresponding pressing arm lifting driving assembly, thereby driving the pressing arm to swing up and down around the hinged support and driving the upper cross beam to ascend and descend in height, wherein each set of pressing arm lifting assemblies includes a pressing rod capable of swinging, and a top end of the pressing rod is hinged with the rear end part or the intermediate part of the pressing arm, wherein the intermediate part of each pressing arm is hinged on the rack through the hinged support correspondingly, and the top end of the pressing rod is hinged with the rear end part of the pressing arm, each set of pressing arm lifting driving assemblies includes the all-electric servo motor, a screw rod, and a sliding block, wherein the all-electric servo motor is configured to drive the screw rod to rotate, the sliding block is threadedly sleeved on the screw rod, and the sliding block is hinged at the bottom end of the pressing rod, wherein a top part of the rack away from the upper cross beam is provided with a sliding track, the sliding block is slidably installed on the sliding track, wherein a sliding pair is formed between the sliding block and the sliding track, and a direction of the screw rod is consistent with that of the sliding track.

2. The heavy-load and high-precision transmission mechanism applicable to the metal sheet bending equipment according to claim 1, wherein a length of each connecting rod is adjustable.

* * * * *